US007109646B2

(12) United States Patent
Morita et al.

(10) Patent No.: US 7,109,646 B2
(45) Date of Patent: Sep. 19, 2006

(54) SPARK PLUG HAVING CENTER ELECTRODE WITH COLUMNAR PORTION AND CONICAL PORTION

(75) Inventors: Hitoshi Morita, Aichi-ken (JP); Shinichi Okabe, Aichi-ken (JP); Masamichi Shibata, Toyota (JP); Tsunenobu Hori, Kariya (JP)

(73) Assignees: Denso Corporation, (JP); Nippon Soken, Inc., (JP)

( * ) Notice: Subject to any disclaimer, the term of this patent is extended or adjusted under 35 U.S.C. 154(b) by 306 days.

(21) Appl. No.: 10/730,885

(22) Filed: Dec. 10, 2003

(65) Prior Publication Data

US 2004/0115976 A1 Jun. 17, 2004

(30) Foreign Application Priority Data

Dec. 10, 2002 (JP) ..... 2002-357611
Sep. 9, 2003 (JP) ..... 2003-316871

(51) Int. Cl.
*H01T 13/20* (2006.01)

(52) U.S. Cl. ..... 313/141; 313/143; 313/144; 123/145 A; 123/145 R

(58) Field of Classification Search ..... 313/141
See application file for complete search history.

(56) References Cited

U.S. PATENT DOCUMENTS 5,866,972 A 2/1999 Matsubara et al. ..... 313/141
5,877,584 A * 3/1999 Kato et al. ..... 313/143
6,215,235 B1 * 4/2001 Osamura ..... 313/141
6,597,089 B1 * 7/2003 Matsutani ..... 313/141
6,762,539 B1 * 7/2004 Klett et al. ..... 313/118
2001/0029916 A1 10/2001 Kanao ..... 123/169 EL

FOREIGN PATENT DOCUMENTS

| | | |
|---|---|---|
| GB | 1497641 | 5/1976 |
| JP | 51-140034 | 12/1976 |
| JP | 1-109675 | 4/1989 |
| JP | 9-260017 | 10/1997 |
| JP | 2001-345162 | 12/2001 |

* cited by examiner

*Primary Examiner*—K Guharay
*Assistant Examiner*—Sikha Roy
(74) *Attorney, Agent, or Firm*—Nixon & Vanderhye PC

(57) ABSTRACT

A spark plug is composed of a main metal fitting having a cylindrical structure, an insulator disposed inside the cylindrical main metal fitting, a center electrode fitted in the insulator in a manner that a front end portion of the center electrode projects outward over one end of the insulator, and a grounding electrode mounted to the main metal fitting and having one end portion opposing to the front end portion of the center electrode through a discharge gap therebetween. The front end portion of the center electrode includes a conical portion having a tapered surface having a taper angle of less than 80°, and a columnar portion formed to a top end portion of the conical portion so as to have a diameter in a range of 0.4 mm to 0.8 mm.

9 Claims, 7 Drawing Sheets

SPARK PLUG HAVING CENTER ELECTRODE WITH COLUMNAR PORTION AND CONICAL PORTION

BACKGROUND OF THE INVENTION

1. Field of the Invention

The present invention relates to a spark plug, for, for example, of an internal combustion engine, especially having an improved structure of a front (tip) end portion of a center electrode thereof.

2. Relevant Art

A spark plug generally comprises a main metal fitting having a cylindrical or tubular shape, an insulator or insulating member accommodated and held in the main metal fitting, a central electrode disposed and held in the insulator in a manner that the front (tip) end portion of the center electrode is exposed outside the insulator, and a grounding electrode (earth electrode) mounted to the main metal fitting so as to oppose to the tip end portion of the center electrode with a discharge gap therebetween.

In the spark plug having such structure, a spark is generated in the discharge gap by applying a voltage. At this spark generation, when a high discharge voltage is applied, the electrode will be consumed earlier, and in order to suppress such earlier consumption of the electrode, it is effective to lower the discharge voltage.

Moreover, in order to effectively utilize a limited combustion space of an engine, recently, it has been required to make compact the spark plug and an ignition coil for applying a voltage to the spark plug. However, in order to make compact the structure of the spark plug, it is generally required to make thin the thickness of the insulator surrounding the center electrode, which will result in that it is difficult for the insulator to withstand against the high discharge voltage in its shape. In this meaning, it becomes necessary to suppress or lower the discharge voltage at the time of ignition.

In conventional art, there has been known a method, as a method of lowering the discharge voltage, in which a columnar tip constituting the tip end portion of the center electrode is formed so as to have a small diameter to thereby concentrate electric field on this fine tip end portion.

It is, however, difficult to obtain an effective lowering of the discharge voltage by considerably making thin the tip end portion of the center electrode, and for example, in a case of the tip end portion having diameter of less than 0.4 mm, no advantageous effect could not be achieved. Accordingly, in the conventional structure, there exists a critical limit to make fine the diameter of the tip end portion.

Furthermore, in the conventional art, there has been further provided a method of reducing the discharge voltage, such as disclosed in Japanese Patent Laid-open (KOKAI) Publication No. HEI 1-109675, in which the tip end portion of the center electrode is formed so as to have a fine diameter and a tapered surface is formed between this fine diameter portion and the center electrode body portion. However, this tapered surface provides a recessed shape towards an axis of the center electrode and not linear shape.

However, in the structure of the tip end portion of the center electrode having the tapered surface as mentioned above, it is difficult to form or work the recessed portion with uniform dimension, thus being also disadvantageous.

In addition, there is further proposed a structure of the tip end portion of the center electrode having such tapered recessed portion in which a length between the small diameter portion of the tip end portion and the connection portion of the tapered surface is made larger. According to this structure, the discharge voltage may be further lowered.

In such structure, however, in a case where this length is made too long of, for example, more than 1.3 mm, a temperature of the tip end portion becomes considerably high and the electrode is hence consumed earlier, thus being also inconvenient.

SUMMARY OF THE INVENTION

An object of the present invention is therefore to substantially eliminate defects or drawbacks encountered in the prior art mentioned above and to provide a spark plug having a compact structure capable of effectively lowering a discharge voltage.

In order to achieve the above object, the inventors of the subject application carried out various investigation and experiments by forming a conical portion and a columnar portion to the center electrode and by changing the diameter of the columnar portion and the taper angle of the conical portion.

The above and other objects can be achieved, based on such investigation and experiments, according to the present invention by providing a spark plug comprising:

a main metal fitting having a cylindrical structure;

an insulator disposed inside the cylindrical main metal fitting and having an inner hollow structure;

a center electrode fitted in the inner hollow portion of the insulator in a manner that a front end portion of the center electrode projects outward over one end of the insulator; and a grounding electrode mounted to the main metal fitting and having one end portion opposing to the front end portion of the center electrode with a discharge gap therebetween, wherein the front end portion of the center electrode includes a conical portion having a tapered surface and a columnar portion formed to a top end portion of the conical portion, the columnar portion having a diameter in a range of 0.4 mm to 0.8 mm, which corresponds to a sectional area thereof in a range of 0.12 $mm^2$ to 0.51 $mm^2$, and the tapered surface of the conical portion having a taper angle of less than 80°.

According to such characteristic feature, the conical portion positioned between the columnar portion and a body portion of the center electrode is provided with a linear tapered surface, which can be easily formed.

Since the columnar portion of the center electrode has the diameter in a range of 0.4 mm to 0.8 mm, which corresponds to a sectional area in a range of 0.12 $mm^2$ to 0.51 $mm^2$, and the tapered surface of the conical portion has the taper angle of less than 80°, the discharge voltage of the spark plug can be lowered and the electric field strength can be concentrated and suitably maintained.

Thus, according to the described invention, there can be provided a spark plug having a compact structure.

In a preferred embodiment, it is desirable that the taper angle is less than 60° or more than 20°.

In a case of the taper angle of less than 20°, the lowering degree of the discharge voltage may be saturated, and in such case, even if the taper angle is further reduced, no effective discharge voltage lowering is not obtainable, and moreover, if the taper angle is made too small, the strength of the front end portion of the center electrode will be easily damaged.

In a further modification, it is desirable that the columnar portion has an axial length in a range of 0.3 mm to 1.0 mm.

That is, in the case of the axial length of the columnar portion of less than 0.3 mm, the usable life time of the spark plug will be shortened through easy consumption thereof, and on the other hand, in the case of more than 1.0 mm, the columnar portion will be easily consumed because of inferior heat radiation thereof.

The distance between the tip end of the columnar portion of the center electrode and the projecting end of the insulator may set in a range of 1.0 mm to 6.0 mm.

Further, the columnar portion and the conical portion of the center electrode are welded by means of laser.

Furthermore, the spark plug may be provided with a mount screw, having a screw diameter of less than M10, formed to an outer peripheral portion of the main metal fitting.

The grounding electrode has a single pole.

The columnar portion may be formed of iridium alloy.

The conical portion has an outer shape prescribed by a circle formed by an intersecting line of a circumferential surface of the columnar portion or a surface which is formed by extending the circumferential surface towards the conical portion side and a conical surface of the conical portion; a circle on a bottom surface side of the conical portion; and a surface not projecting over a conical surface connecting the two circles.

As mentioned hereinabove, according to the characteristic features of the present invention, there can be provided a spark plug capable of suitably lowering the discharge voltage with a compact structure thereof.

The nature and further characteristic features of the present invention will be made more clear from the following descriptions made with reference to the accompanying drawings.

BRIEF DESCRIPTION OF THE DRAWINGS

In the accompanying drawings:

FIG. 2, including

FIG. 5, including

DESCRIPTION OF THE PREFERRED EMBODIMENT

A preferred embodiment of a spark plug of the present invention will be described hereunder with reference to the accompanying drawings.

Figure 1A:
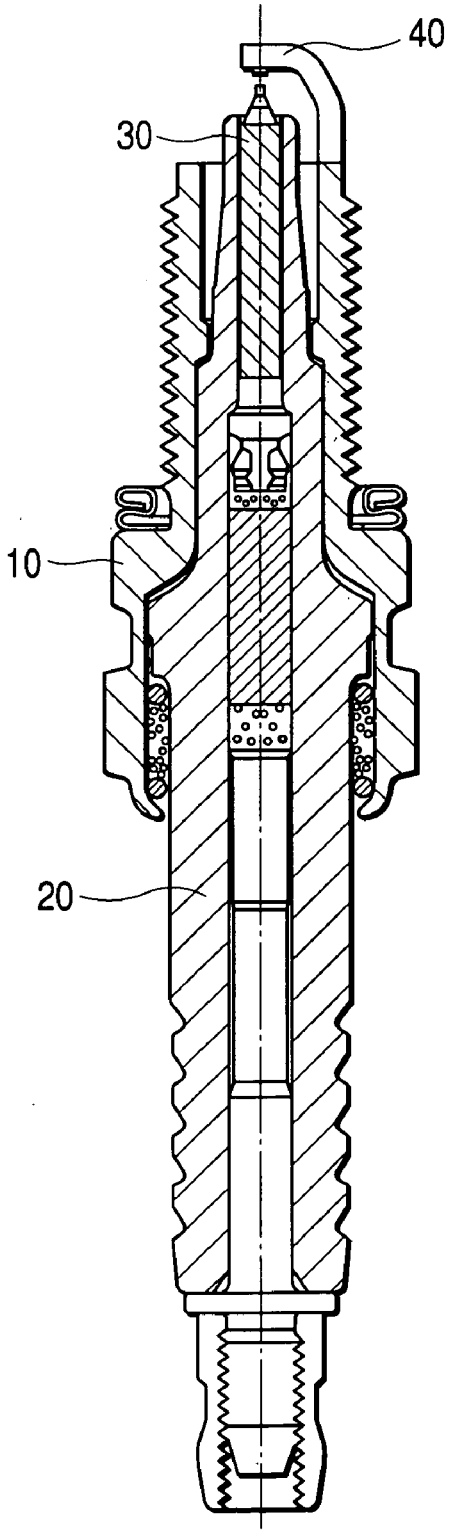
FIG. 1A is a longitudinal sectional view of a spark plug according to an embodiment of the present invention and FIG. 1B is a schematic sectional view, in an enlarged scale, of one end portion of the spark plug according of FIG. 1A.
Figure 1B:
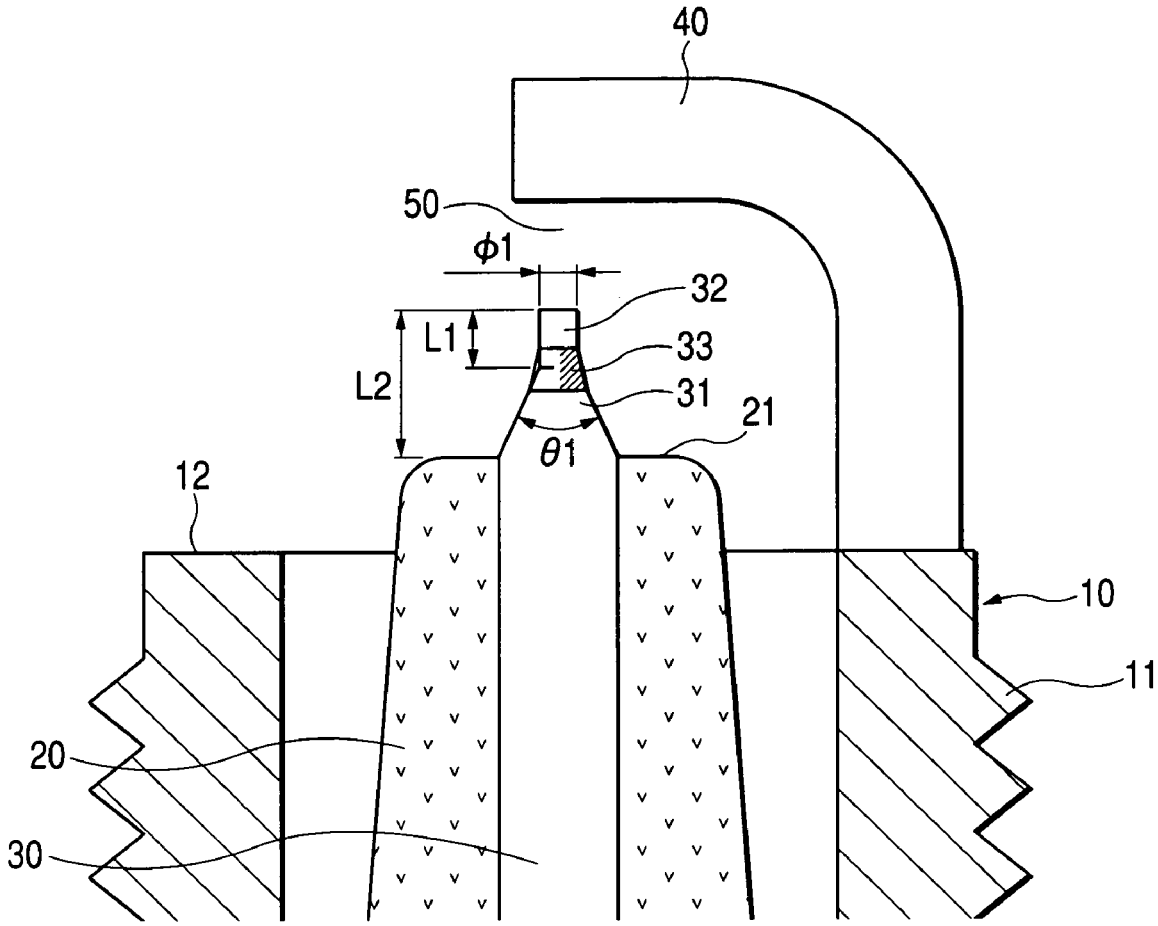

With reference to FIG. 1 (FIGS. 1A and 1B), a spark plug includes a main metal fitting 10 which is formed of a carbon steel so as to provide a cylindrical or tubular shape through cold forging or cut working process. In the illustration of FIG. 1, one end side 12 of the main metal fitting 10 is shown. The main metal fitting 10 has an outer periphery to which screw threads are formed so as to be mounted to an engine, for example, an internal combustion engine, and it is desired for the screw thread to have a diameter of less than M10.

An insulator or insulating member 20 is disposed and held inside the cylindrical structure of the main metal fitting 10, and the insulator 20 is formed of an electrically insulating material such as alumina. The insulator 20 has an inner hollow structure having a hole extending in its axial direction, and a center electrode 30 is fitted into this hollow axial hole in a manner electrically insulated from the main metal fitting. A terminal, not shown, is fitted to the other one end of the main metal fitting 10 so as to electrically connected to the center electrode 30.

The center electrode 30 has a rod shape extending in the axial direction of the spark plug, i.e., axial direction of the main metal fitting 10, and has a front (tip) end portion projects outward from the end portion 12 of the main metal fitting 10 and the end portion 21 of the insulator 20. The front end portion of the center electrode 30 has a structure including a conical portion 31 and a columnar portion 32 formed to the top end of the conical portion 31. The columnar portion 32 has a diameter slightly smaller than that of the top end portion of the conical portion 31.

The conical portion 31 has a tapered structure finely extending, with a constant taper angle of θ 1, towards the front end portion of the center electrode 30, and the columnar portion 32 has a diameter of ϕ 1 and an axial length of L1 extending in the axial direction of the spark plug.

Further, in a case where the conical portion 31 and the columnar portion 32 are formed from independent parts from each other, there may be adopted a structure in which the columnar portion 32 formed of platinum alloy or iridium alloy is fixed, by means of welding, for example, to the front end portion of the conical portion 31 formed of nickel alloy or like through press working or cut working. In this embodiment, the conical portion 31 and the columnar portion 32 are welded by means of laser. In an alternation, however, these portions 31 and 32 may be formed integrally through the press working or cut working.

Figure 2A:
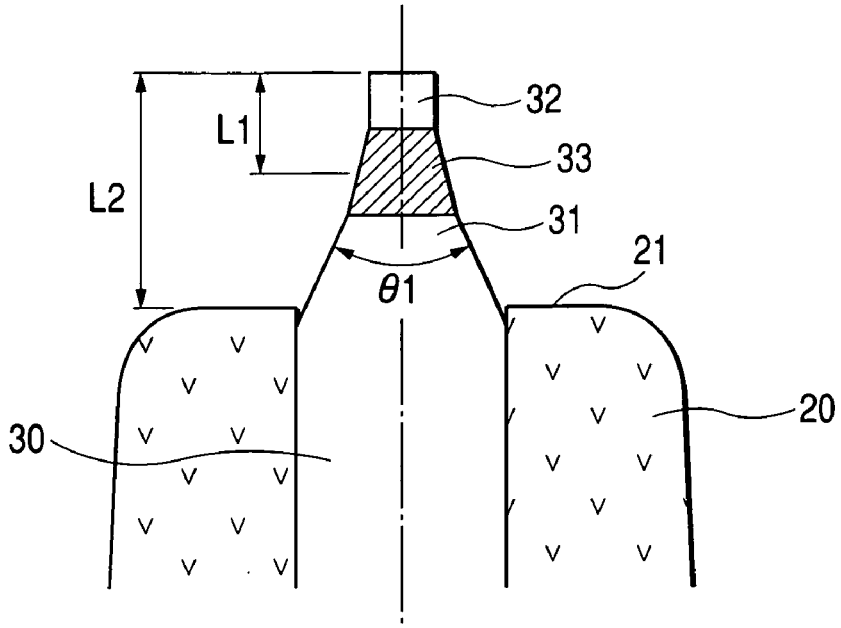
FIGS. 2A and 2B, is an illustration of a tip end portion of a center electrode of the spark plug of FIG. 1 to which a laser welding is applied.
Figure 2B:
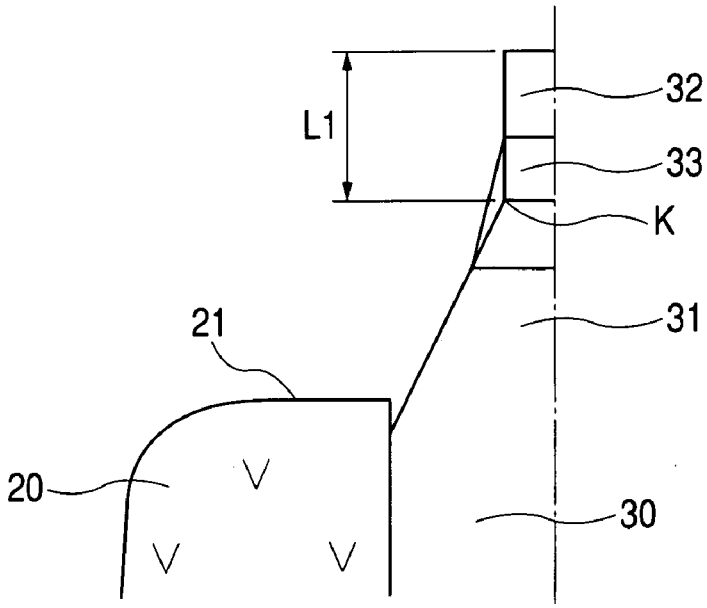

In the shown and described embodiment, the conical portion 31 and the columnar portion 32 are formed as independent bodies or members, and the columnar portion 32 formed of iridium alloy is fixed to the conical portion 31 formed of nickel alloy by means of laser welding. FIGS. 2A and 2B show the detailed structure of the front end portion of the center electrode 30 formed with the structure mentioned above.

With reference to FIG. 2A, the front end portion of the center electrode 30 includes a fused portion 33, at the boundary portion of the conical portion 31 and the columnar portion 32, at which both the portions 31 and 32 are fused and mixed. That is, the conical portion 31 and the columnar portion 32 of the front end portion of the center electrode 30 are fixed together through such fused portion 33.

According to such structure, the length L1 of the columnar portion 32 will be defined as follows.

That is, as shown in FIG. 2B, supposing that an intersecting portion of an extension of an outer peripheral surface of the columnar portion 32 towards the fused portion 33 and an extension of the tapered outer peripheral surface of the conical portion 31 towards the fused portion 33 constitutes a virtual surface K, the length L1 is defined as a distance between the top end portion of the columnar portion 32 and this virtual surface K.

Further, the shape of the conical portion 31 will be prescribed as follows.

The conical portion has an outer shape prescribed by a circle formed by an intersecting line of the circumferential surface of the columnar portion or a surface which is formed by extending the circumferential surface towards the conical portion side and the conical surface of the conical portion; a circle on a bottom surface side of the conical portion; and a surface not projecting over a conical surface connecting these two circles.

Further, in the embodiment in which the fused portion 33 is formed, the former circle in the above two circles is a circle formed by the intersecting line of the extension of the circumferential surface of the columnar portion 31 towards the conical portion 31 and the conical surface of the conical portion 31.

Here, in the present embodiment, the diameter ϕ 1 of the columnar portion 32 is more than 0.4 mm and less than 0.8 mm, and the taper angle θ 1 of the conical portion 31 is less than 80°. It is to be noted that the term "taper angle" herein is one prescribed by JIS (Japanese Industrial Standard) B0612. Further, it is preferred that the taper angle θ 1 has an upper limit of less than 60° and lower limit of more than 20°.

Furthermore, it is also preferred that the length L1 of the columnar portion 32 is more than 0.3 mm and less than 1.0 mm, and a length L2 of the front end portion of the center electrode 30 between the end portion 21 of the insulator 20 and the front end portion of the center electrode 30 (tip end of the columnar portion 32) is in a range of 1.0 mm to 6.0 mm.

The spark plug of the embodiment is further provided with a grounding electrode 40 arranged so as to oppose to the front end of the center electrode 30, i.e., tip end of the columnar portion 32.

The grounding electrode 40 has one end fixed to one end of the main metal fitting 10 by means of welding, for example, and the other end bent at its middle portion so as to oppose to the tip end of the columnar portion 32 with a discharge gap 50 defined therebetween. A discharge spark is generated in this discharge gap 50 by applying a voltage between the center electrode 30 and the grounding electrode 40.

As described hereinbefore, according to the spark plug of the present invention, the front end portion of the center electrode 30 is formed so as to be composed of the conical portion 31 and the columnar portion 32 formed to the top end of the conical portion 31. According to this structure, the tapered surface formed between the body portion, having a larger diameter, of the center electrode 30 and the base end portion of the columnar portion 32 having a small diameter constitutes a conical surface having a linear taper shape. Such tapered surface will be easily worked in comparison with the working of the conventional recessed tapered surface such as mentioned herein as the background art.

Figure 3:
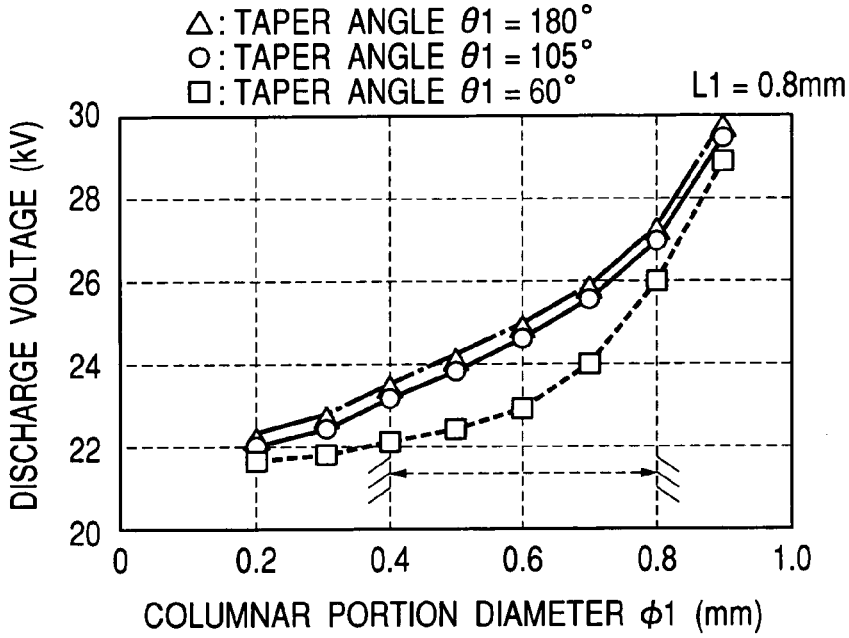
FIG. 3 is a graph showing a relationship between a diameter ϕ 1 of a columnar portion, a taper angle θ 1 and a discharge voltage.
Figure 4:
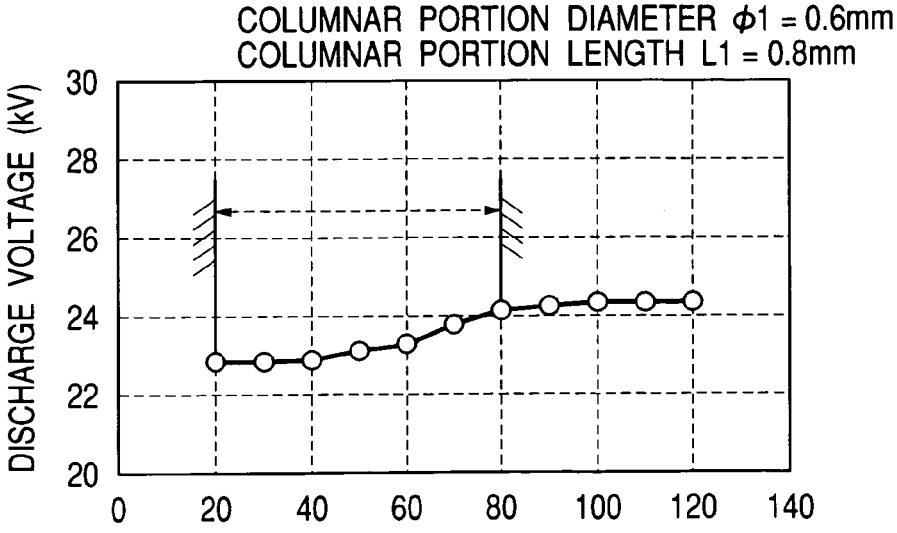
FIG. 4 is a graph showing a relationship between a taper angle θ 1 of a conical portion and a discharge voltage.

Furthermore, according to the preferred embodiments of the present invention, the diameter ϕ 1 of the columnar portion, the axial length L1 thereof, the taper angle θ 1 of the conical portion 31 and the length L2 of the front end portion of the center 30 are defined to preferred values or ranges, which were obtained through experiments, such as shown in FIGS. 3 to 5. Further, it is of course to be noted that the present invention is not necessarily limited to these described values.

The graph of FIG. 3 represents the relationship between the diameter ϕ 1 of the columnar portion 32, a discharge voltage and the taper angle θ 1 of the conical portion 31, and herein, the term "discharge voltage" means a voltage at a time of starting the generation of the spark in the discharge gap 50 between the center electrode 30 and the grounding electrode 40.

In the experiment of FIG. 3, there were prepared spark plugs having center electrodes having conical portions having taper angles θ 1 of 60°, 105°, 180°, to which columnar portions 32 having different diameters were applied, and the discharge voltages were measured. In this experiment, the columnar portion 32 having a length L1 of 0.8 mm was utilized. As seen from the graph of FIG. 3, in the case of the taper angles θ 1 of 105° and 180°, the relationships between the diameter of the columnar portion 32 and the discharge voltage show substantially the same result.

On the other hand, in the case of the taper angle θ 1 of 60°, voltage drop of the discharge voltage of about 10% in maximum was observed in the case of the columnar portion 32 having the diameter ϕ 1 in the range of 0.4 mm to 0.8 mm. That is, in this condition, advantageous effect caused and obtainable by making small the taper angle θ 1 could be confirmed.

On the contrary, in the case of the diameter ϕ 1 out of the range of 0.4 mm to 0.8 mm, only small advantageous effect could be confirmed.

The advantageous effect due to such taper angle θ 1 of the conical portion 31 in the case of the columnar portion 32 having a diameter ϕ 1 in the range of 0.4 mm to 0.8 mm was evenly confirmed in the length range of the columnar portion 32 of 0.3 mm to 1.0 mm. This range of the length L1 is considered to be a practical level in view of the consumption of the center electrode.

That is, in the case of the length L1 of less than 0.3 mm, the columnar portion 32 is easily consumed, which will adversely result in the usable life of the central electrode 30, and on the other hand, in the case of the length L2 of more than 1.0 mm, the columnar portion 32 shows adverse heat radiation function, which will result in easy consumption of the center electrode 30.

Next, the graph of FIG. 4 shows the relationship between a discharge voltage and the taper angle θ 1 of the conical portion 31, which was obtained through the experiment using the columnar portion 32 having the diameter ϕ 1 of 0.6 mm and the length L1 of 0.8 mm.

As can be seen from the graph of FIG. 4, the lowering of the discharge voltage was hardly observed in the case that the taper angle θ 1 of the conical portion 31 was reduced to 80° but was remarkably observed in the case of the taper angle θ 1 of less than 80°. That is, in the case of the taper angle θ 1 of less than 80°, the discharge voltage is lowered by 1 kV in maximum in comparison with the case of the taper angle θ 1 of more than 80°, which is remarkable realization of the lowering of the discharge voltage. In the case of the taper angle of less than 20°, it was also observed that the lowering of the discharge voltage was saturated and the discharge voltage was no more lowered.

The advantageous effect due to the lowering of the taper angle θ 1 of the conical portion 31 to less than 80° was evenly confirmed in the case of the columnar portion 32 having a diameter ϕ 1 in the range of 0.4 mm to 0.8 mm and in the range of the length L1 thereof of 0.3 mm to 1.0 mm.

Furthermore, it was also confirmed that the advantageous effects due to the lowering of the discharge voltage shown in FIGS. 3 and 4 were especially effectively attained in the range of the length L2 of the front end portion of the center electrode 30 of 1.0 mm to 6.0 mm. However, in the present invention, the length L2 is not limited to this range from the above fact in the experiments.

Still furthermore, an experiment was performed for confirming that the lowering of the discharge voltage is caused by the increasing of the electric field strength at the front end portion of the center electrode 30 and inspecting the relationship between the taper angle θ 1 of the conical portion 31 and the field strength based on the field analysis, which was effected by utilizing the finite element method (FEM).

Figure 5A:
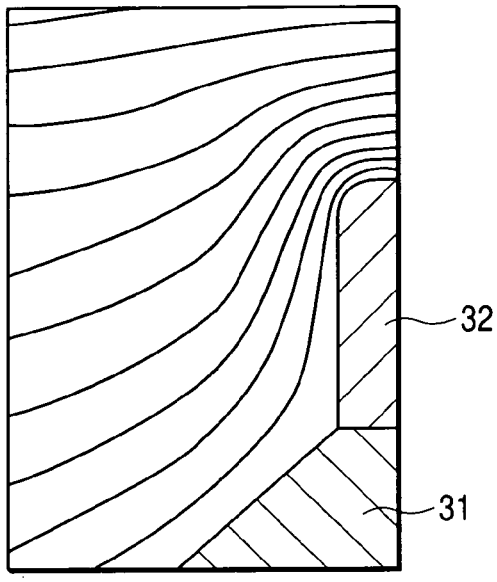
FIGS. 5A and 5B, is an illustration showing an equipotential line distribution through electric field analysis.
Figure 5B:
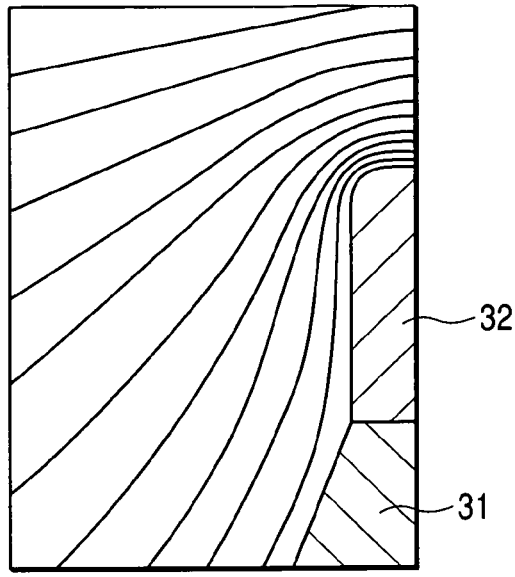

FIG. 5 is a graph showing one example of a result of the field analysis, in which the equipotential distribution is shown at a time of application of 30 kV voltage to the center electrode 30 (0 kV to the grounding electrode 40) based on the field analysis. Further, FIG. 5A represents the case of the taper angle θ 1 of 105° and FIG. 5B represents the case of the taper angle θ 1 of 40°.

In this equipotential distribution, the case where the interval or distance between adjacent equipotential lines narrows represents the case that the field strength is concentrated accordingly. As can be seen from FIG. 5, when the taper angle θ 1 narrows from 105° to 40°, the curve of the equipotential lines at the front end portion of the center electrode 30 become sharp and the field strength increases locally.

Since the tapered shape of the conical portion 31 is made sharp at the taper angle θ 1 of 40° in comparison of the tapered shape at the taper angle θ 1 of 105°, the interval of the equipotential lines becomes narrow. According to this phenomenon, the equipotential lines at the front end portion of the center electrode 30, i.e., the tip end of the columnar portion 32, also become narrow and the field strength is hence increased.

Figure 6:
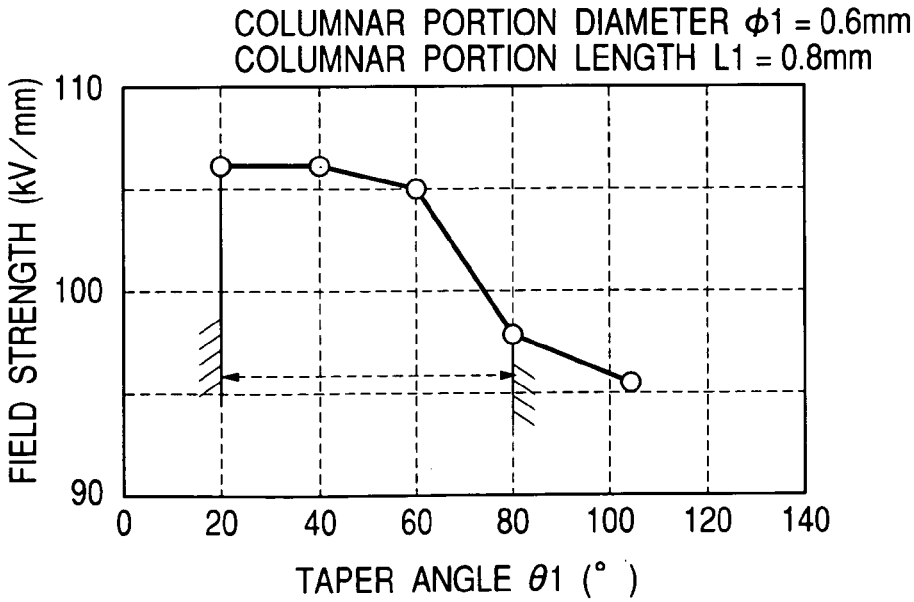
FIG. 6 is a graph showing a relationship between a taper angle θ 1 and an electric field strength through the electric field analysis.

FIG. 6 is a graph showing the relationship between the taper angle θ 1 and the field strength based on the field analysis in the case where the taper angle was changed. In this field analysis, there was used the columnar portion 32 having the diameter ϕ 1 of 0.6 mm and the length L1 of 0.8 mm.

As can be seen from FIG. 6, in the case of the taper angle θ 1 of less than 80°, the magnitude of the field strength concentrating to the tip end of the columnar portion 32 of the center electrode 30 was increased by about 10% in comparison with that in the case of taper angle θ 1 of more than 80°.

From the above fact, it wan found that, by making the taper angle θ 1 less than 80°, the electric field is concentrated to the front end portion of the center electrode 30 even if the discharge voltage be lowered, thus causing and realizing a suitable spark discharge between the center electrode 30 and the grounding electrode 40.

Consequently, as can be seen from the showing and description of FIGS. 3 to 6 based on the experimental results, the electric field strength could be concentrated and the discharge voltage of the spark plug could be hence lowered by constructing the columnar portion 32 of the center electrode 30 so as to provide a diameter ϕ 1 in the range of 0.4 mm to 0.8 mm and constructing the conical portion 31 thereof so as to provide a taper angle θ 1 of less than 80°.

Further, as can be seen from FIGS. 4 and 6, in the case where the upper limit of the taper angle θ 1 is less than 60°, further concentration of the field strength to the front end portion of the center electrode could be realized, and more remarkable discharge voltage lowering could be also realized, thus having been practical and advantageous.

The reason why the lower limit of the taper angle θ 1 is preferably of more than 20° resides in that the discharge voltage lowering phenomenon is saturated in the case of the taper angle θ 1 of less than 20°, and the effect due to this discharge voltage lowering is not attained, in the case of further reducing the taper angle, as shown in FIG. 4, and moreover, in the case of further small taper angle, the field strength at the front end portion of the center electrode 30 becomes weak.

Further, in general, it is known that the field strength is increased and the discharge voltage is lowered by making sharp the front end portion of the center electrode.

According to the illustrated and described embodiment, however, as shown in the graphs of FIGS. 5 and 6, substantially the same effects as those achieved by the structure, in which the front edge portion is made sharp, can be achieved by making sharp the taper angle θ 1 of the conical portion 31 not contacting the discharge spark without making sharp the tip end of the columnar portion 32 of the center electrode 30.

Moreover, in general, the edge portion of the front end of the center electrode 30 is gradually made round by the repeated use of the spark plug. However, according to the present invention, in such case, the field strength can be suitably concentrated. Therefore, the lowering of the discharge voltage can be maintained in the long term, and the present invention is especially applicable to a spark plug having the mount screw portion 11 having a screw diameter of less than M10.

As descried hereinbefore, according to the embodiment of the present invention, it becomes possible to provide a compact spark plug by suitably lowering the discharge voltage.

[Consideration to Grounding Electrode]

The inventors of the subject application further investigated and experimented to know or judge whether the relationship between the taper angle θ 1 of the conical portion 31 of the center electrode and the discharge voltage is influenced by the shape of the grounding electrode.

Figure 7A:
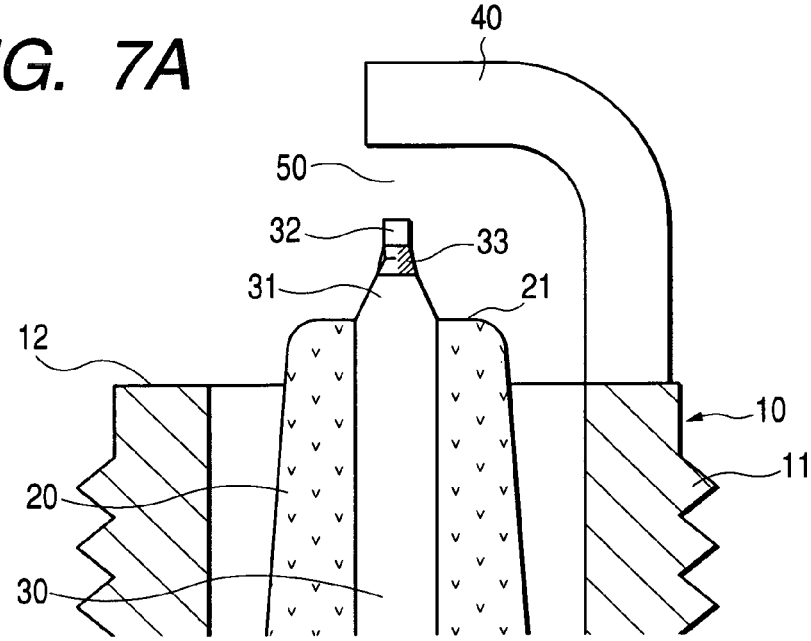
FIG. 7 includes FIG. 7A showing an essential portion of a spark plug having a grounding electrode of a single-pole structure and FIG. 7B showing an essential portion-of a spark plug having a grounding electrode of a three-pole structure.
Figure 7B:
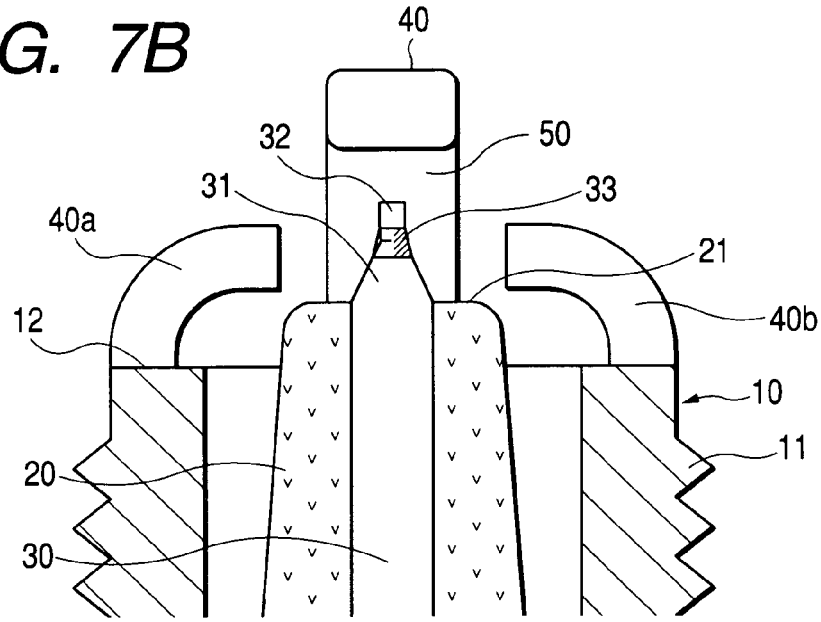

In the experiment, a spark plug having a single-pole grounding electrode 40 of FIG. 7A including one electrode, such as that shown in FIG. 1, and a spark plug having three-pole grounding electrode including three electrode pieces 40, 40*a*, 40*b* of FIG. 7B were compared.

The three-pole grounding electrode shown in FIG. 7B has a structure including a main electrode piece 40 and sub-electrode pieces 40*a* and 40*b*. The sub-electrode pieces 40*a* and 40*b* are grounding electrodes for surface creepage for preventing, so-called, carbon fouling.

Each of these sub-electrode pieces 40*a* and 40*b* has one end fixed to the main metal fitting 10 by means of welding or like and the other end which is bent at its middle portion so that the bent front end thereof opposes to the side surface of the tip end of the columnar portion 32 of the center electrode 30.

Figure 8:
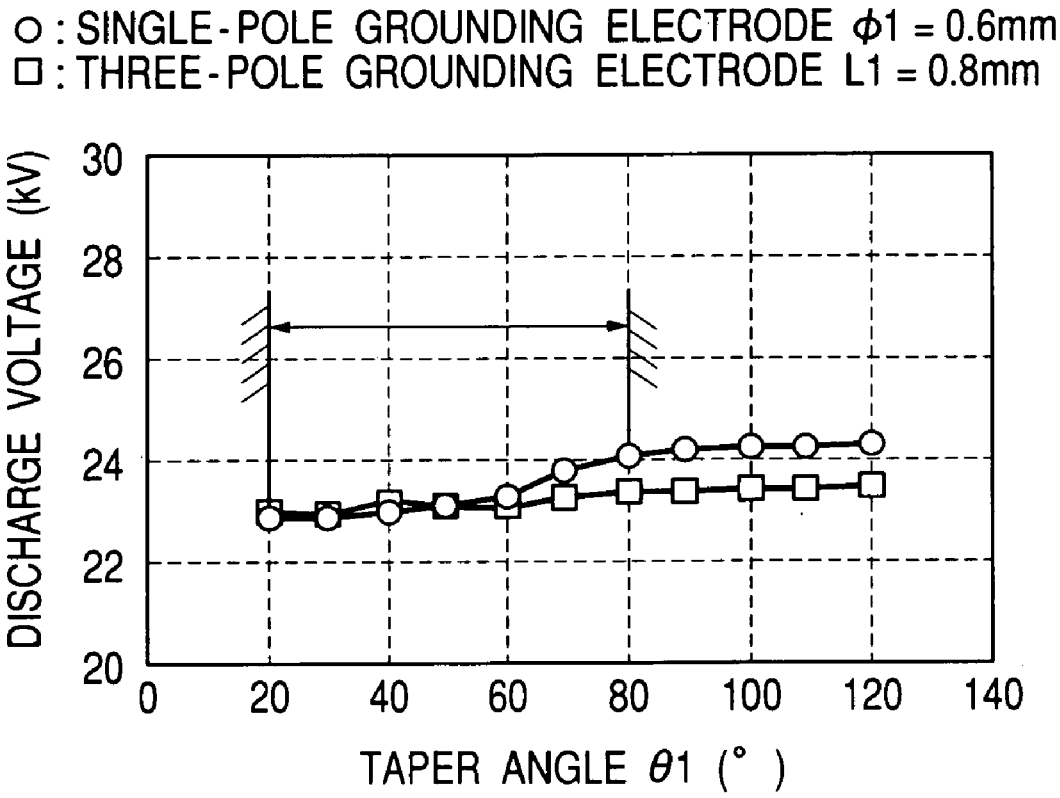
FIG. 8 is a graph showing a relationship between the taper angle θ 1 of a conical portion and a discharge voltage with respect to the spark plugs having single- and three-pole grounding electrodes.

FIG. 8 is the graph showing a result of investigation or experiment how or in what manner the relationship between the taper angle θ 1 of a conical portion and a discharge voltage with respect to the spark plugs having single- and three-pole grounding electrodes is influenced by the shape of the grounding electrode.

In the experiment concerning the graph of FIG. 8, there was used a spark plug having a columnar portion 32 of the center electrode having a diameter ϕ 1 of 0.6 mm and length L1 of 0.8 mm. As seen from the graph of FIG. 8, the structure of the single-pole grounding electrode provided effects similar to those attained by the structure of FIG. 4.

That is, in the case of the spark plug having the single pole grounding electrode, the lowering of the discharge voltage was hardly observed in the case that the taper angle θ 1 of the conical portion 31 was reduced to 80° but was remarkably observed in the case of the taper angle θ 1 of less than 80°. That is, in the case of the taper angle of less than 80°, the discharge voltage was lowered by 1 kV in maximum in comparison with the case of the taper angle of more than 80°.

On the other hand, in the case of the spark plug having the three-pole grounding electrode, the lowering of the discharge voltage could not observed not so much as in the single-pole grounding electrode even in the case of the taper angle of less than 80°. This is supposed as follows. In the grounding electrode having three electrode pieces, as shown in FIG. 7B, the sub-grounding electrode pieces 40*a* and 40*b* for the surface creepage exist at portions near the front end portion of the center electrode 30. When the interval between the sub-grounding electrode piece 40*a* (40*b*) and the center electrode 30 narrows, the distance between the equipotential lines therebetween also narrows, and hence, the field strength at the front end portion of the center electrode 30 is increased.

For this reason, in the structure of the three-pole grounding electrode, the discharge voltage to the main grounding electrode piece 40 is lowered in comparison with the structure of the single-pole grounding electrode.

Accordingly, even in the case of the taper angle θ 1 of more than 80°, in the three-pole grounding electrode, there is provided a lower discharge voltage as like as in the case of the spark plug having the single-pole grounding electrode and the taper angle of less than 60° of the conical portion of the center electrode as shown in FIG. 8.

As described above, according to the present invention, in the structure of the spark plug having the three-pole grounding electrode, it is considered that even if the taper angle be reduced, the discharge voltage lowering phenomenon would be saturated. Thus, the structure of the spark plug of the type having the single-pole grounding electrode can achieve the discharge voltage lowering effect which is superior to that in the structure of the spark plug having the three-pole grounding electrode.

What is claimed is:

1. A spark plug comprising:

a main metal fitting having a cylindrical structure;

an insulator disposed inside the cylindrical main metal fitting and having an inner hollow structure;

a center electrode fitted in the inner hollow portion of the insulator in a manner that a front end portion of the center electrode projects outward over one end of the insulator; and a grounding electrode mounted to the main metal fitting and having one end portion opposing to the front end portion of the center electrode with a discharge gap therebetween, wherein said front end portion of the center electrode includes a conical portion having a tapered surface and a columnar portion formed to a top end portion of the conical portion, said columnar portion having a diameter in a range of 0.4 mm to 0.8 mm and said tapered surface of the conical portion having a taper angle of less than 80°, and wherein said columnar portion has an axial length in a range of 0.3 mm to 1.0 mm.

2. A spark plug according to claim 1, wherein said taper angle is less than 60°.

3. A spark plug according to claim 1, wherein said taper angle is more than 20°.

4. A spark plug according to claim 1, wherein a distance between the tip end of the columnar portion of the center electrode and the projecting end of the insulator is in a range of 1.0 mm to 6.0 mm.

5. A spark plug according to claim 1, wherein said columnar portion and said conical portion of the center electrode are welded by means of laser.

6. A spark plug according to claim 1, further comprising a mount screw formed to an outer peripheral portion of the main metal fitting.

7. A spark plug according to claim 1, wherein said grounding electrode has a single-pole structure.

8. A spark plug according to claim 1, wherein said columnar portion is formed of iridium alloy.

9. A spark plug according to claim 1, wherein said conical portion has an outer shape that is linearly tapered along a line between a circumferential surface of the columnar portion or a surface which is formed by extending the circumferential surface towards the conical portion side and a bottom end portion of the conical portion.

* * * * *